US005655272A

United States Patent [19]

Young

[11] Patent Number: 5,655,272

[45] Date of Patent: Aug. 12, 1997

[54] SCARF CINCH

[75] Inventor: Judith A. Young, Hastings-on-Hudson, N.Y.

[73] Assignee: Le Reve Corporation, Hastings-on-Hudson, N.Y.

[21] Appl. No.: 399,205

[22] Filed: Mar. 6, 1995

[51] Int. Cl.[6] ..... A44B 21/00

[52] U.S. Cl. ..... 24/482; 24/17 B

[58] Field of Search ..... 24/17 B, 482, 24/115 H, 66.9, 58, 130, 66.2, 49.1, 715.3, 115 K, 300, 301, 129 W, 129 R, 115 G; 2/207, 145, 148; D11/202; D2/501; 132/273, 275; 206/805

[56] References Cited

U.S. PATENT DOCUMENTS

| | | | |
|---|---|---|---|
| 937,593 | 10/1909 | Givens | 24/17 B |
| 1,167,719 | 1/1916 | Saulmon | 24/17 B |
| 2,273,136 | 2/1942 | Orech et al. | 24/129 R X |
| 2,313,280 | 3/1943 | Szego | 24/129 R |
| 2,941,213 | 6/1960 | Eliasberg | 24/66.9 X |
| 3,081,781 | 3/1963 | Stermer | 132/273 |
| 3,204,305 | 9/1965 | Deex | 24/66.9 |
| 3,988,850 | 11/1976 | Steinman | 24/115 H X |
| 5,208,950 | 5/1993 | Merritt | 24/115 H |

FOREIGN PATENT DOCUMENTS

| | | | |
|---|---|---|---|
| 2642940 | 8/1990 | France | 24/700 |
| 13946 | of 1899 | United Kingdom | 24/129 D |

OTHER PUBLICATIONS

Photocopy of device used in hair styling Date: Exact date unknown, but it was on sale more than one year prior to the filing date of the application.

*Primary Examiner*—James R. Brittain
*Attorney, Agent, or Firm*—Darby & Darby

[57] ABSTRACT

A scarf cinch formed of a loop of elastic cord having a mount along the loop to define two sub-loops so that a part of a scarf can be passed through and held by the elastic action of the cord of each sub-loop. The mount can be made adjustable along the loop to change the sizes of the sub-loops. Two or more loops angularly positioned with respect to each other can be attached at a common mount point that is fixed or an adjustable mount can be used to select the size of each of the sub-loops.

12 Claims, 2 Drawing Sheets

SCARF CINCH

BACKGROUND OF THE INVENTION

Scarves are a well known accessory item of wearing apparel. A scarf is usually worn to complement other items of apparel and is basically for decorative purposes. They are generally colorful items with decorative patterns that are to be displayed. The most common way of a user wearing a scarf around the neck is to knot the scarf to hold it in place. While this is effective, the knot can be bulky and detracts from the scarf's full decorative potential. The knot restricts the lay of the scarf and the scarf's free ends extending from the knot lose their ability to make a decorative contribution. Also, the knot takes material away from the scarf length, and also can crease the scarf material. Further, it is difficult for many users lacking the talent to tie the knot and still achieve a fashionable look.

BRIEF DESCRIPTION OF THE INVENTION

The present invention relates to a scarf cinch that is capable of holding a scarf to a part of the user's body, such as the neck. The cinch also can be used to fasten a scarf around another item, such as using a scarf as a hatband. In accomplishing the scarf fastening, the cinch of the invention exploits the scarf's full decorative potential since it does not require use of scarf material for tying a knot. The cinch is simple to use and requires no tying of a knot. This permits the full fashion effect of the scarf to be realized. The cinch also allows for easy adjustment of scarf parts to achieve a desired decorative effect.

The cinch of the invention includes a closed loop of elastic cord having a mount along the loop to form two sub-loops. The mount is preferably adjustable along the length of the closed loop to set the size of the individual sub-loops. A part of the scarf is to be passed through each of the sub-loops and parts of the scarf can be pulled out from each of the sub-loops to billow a selected part or parts of the scarf. This permits obtaining a variety of aesthetic effects. The elasticity of the sub-loops provides a firm holding action for the scarf material and no knot is needed.

Also, according to the inventor, two or more closed loops can be held by the mount to establish four or more sub-loops and an adjustable mount can be used to set the size of each of the sub-loops whose sizes are adjustable. Further, the mount can permit angular orientation of the pairs of sub-loops.

OBJECTS OF THE INVENTION

It is therefore an object of the invention to provide a scarf cinch to hold the scarf to a part of the body or other item such as a hat with the cinch having a pair of elastic sub-loops, each for holding a part of a scarf.

Another object is to provide a cinch for a scarf formed of a closed loop of elastic cord divided into sub-loops by a mount that is adjustable along the length of the loop to set the size of the sub-loops.

Yet a further object is to provide a scarf cinch in which a mount holds a plurality of closed loops of elastic cord to divide each closed loop into a pair of sub-loops.

An additional object is to provide a scarf cinch for holding a pair of closed loops of elastic cord and forming a pair of sub-loops from each closed loop while permitting both adjustment of the sizes of the sub-loops and their relative angular orientation.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
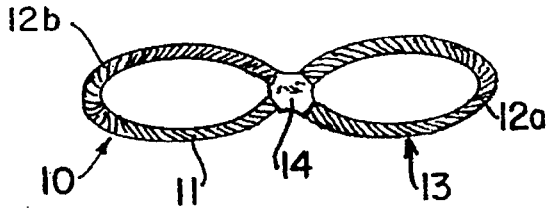
FIG. 1 is a perspective view of one form of the cinch in accordance with the invention.

FIG. 1 shows a scarf cinch 10 formed of a closed loop 11 of elastic cord 13. An appropriate length of the cord is secured at its ends to form the closed loop to its desired length. The elastic cord 13 can be any suitable type, with the usual rubberized elastic preferred. The cord can be of any desired color and its diameter is typically 0.15–0.25", although other suitable diameters can be used. Also, the closed loop 11 can be of any desired size, depending upon the thickness of the scarf material to be held.

The loop 11 is divided, here shown at a point near its center, by a mount 14 to form two sub-loops 12*a*, 12*b*. In FIG. 1, the mount 14 is fixed to two opposing parts of the main loop cord. Fixing of the mount 14 to the loop cord can be accomplished by an adhesive, a molded piece of plastic placed at the desired location on the loop 11 with the plastic piece being heat sealed or heat deformed. The mount also can be a metal clip or clamp, including one that is ornamental. When the mount 14 is at the center of the main closed loop 11, the sub-loops 12*a*, 12*b* are of equal size and the cinch has a generally FIG. 8 shape. The mount 14 also can be located at a position other than the main loop midpoint to make one sub-loop 12*a* or 12*b* larger than the other.

Figure 2:
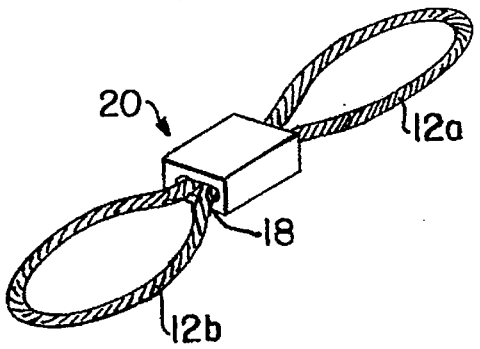
FIG. 2 is a perspective view of another embodiment of the cinch with an adjustable mount.

FIG. 2 is a view of another embodiment of the invention wherein the mount is in the form of a block 20 having a central channel 18 through which the two parts of the closed loop 11 extend. There is a tight engaging, but sliding, fit of the two parts of the loop 11 within the channel. This permits the loop 11 to be slid within the channel 18 to adjust the sizes of the sub-loops 12*a*, 12*b*. Mount block 20 can be of any suitable material, such as plastic, wood, metal, etc., which is molded, cast or carved with the channel 18 formed as needed. The mount 20 can be of any desired size and shape and also can be decorated, for example, have a painted surface or a suitably attached design ornament or plate.

Figure 6:
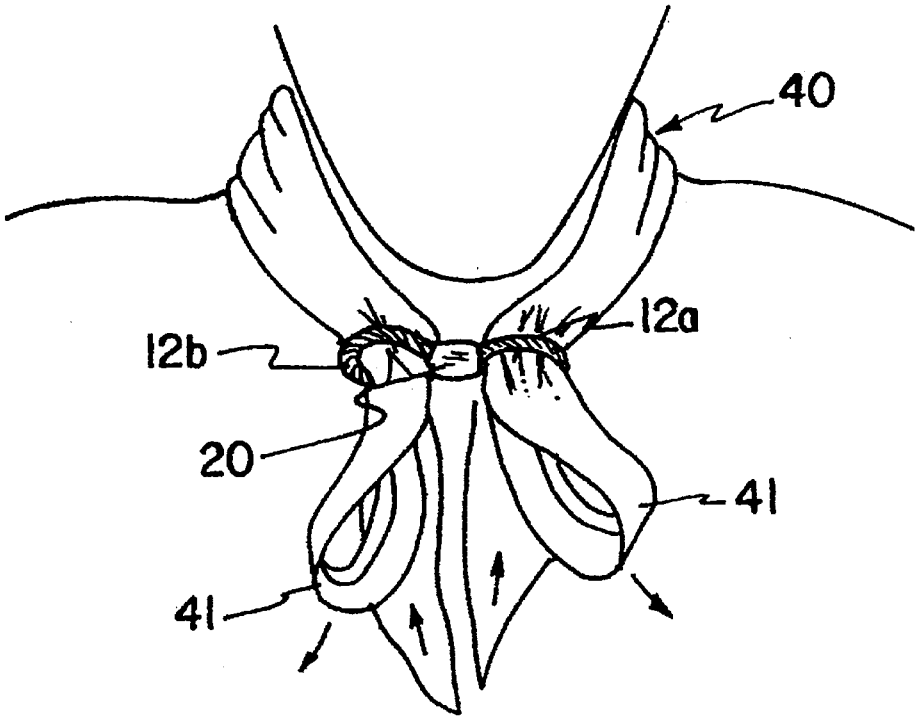
FIGS. 6 and 7 show views of a scarf held by the scarf cinch.
Figure 7:
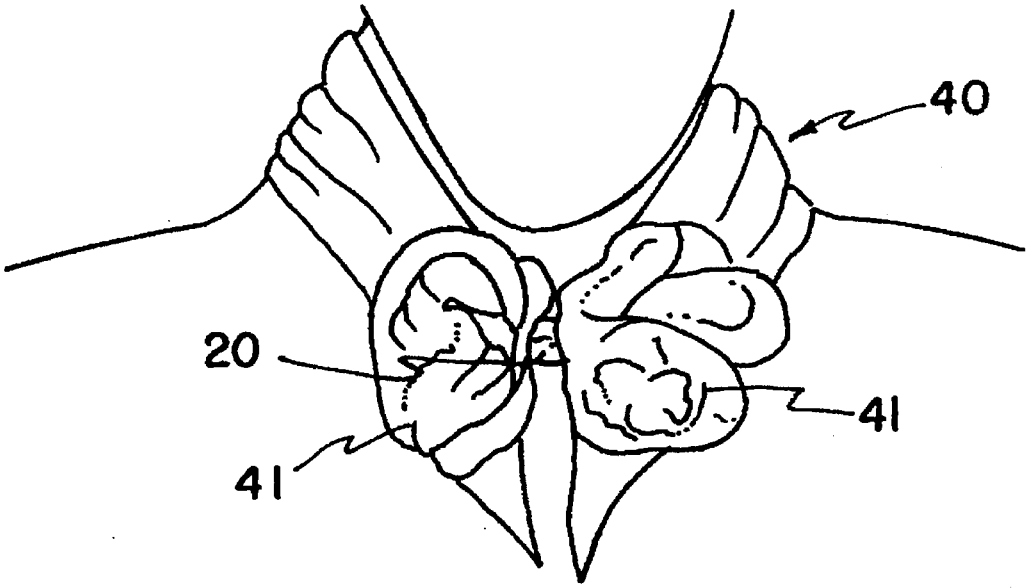

In use, as shown in FIGS. 6 and 7, an end 41 of the scarf 40 is passed through each of the sub-loops 12*a* and 12*b*. The scarf end can be doubled over within a sub-loop and the doubled over part fluffed out to form a billow or bow. Other configurations of the scarf material can be achieved as desired. Also, the cinch can be used in place of a knot with just an end of the scarf passing through each of the sub-loops. The scarf material, after being adjusted to the desired shape, is held in place within each sub-loop 12*a*, 12*b* by the elastic action of the loop cord. As can be seen, the full scarf is available to be viewed and there is no knot. Also, as seen in FIG. 6, the mount block 20 can be left open for view or it can be covered.

Figure 3:
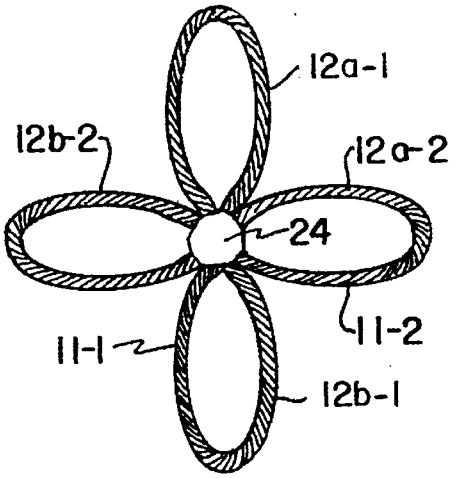
FIG. 3 is a view of a further embodiment of the cinch with multiple loops.

FIG. 3 shows a further embodiment of the invention. Here, two closed loops 11-1 and 11-2 of the elastic cord 13 are provided. The two loops 11-1 and 11-2 of the elastic cord can be of the same or different sizes. They are shown mounted transverse to each other by a mount 24 at about the midpoint of each of the loops. This forms a four-leaf clover design, providing sub-loops 12*a*-1 and 12*b*-1 from loop 11-1 and sub-loops 12*a*-2 and 12*b*-2 from loop 11-2. As in the case of and as described in FIG. 1, the mount 24 is of a type permanently fixed to the opposing two parts of the two loops 11-1 and 11-2. Here also the sub-loops of each of the loops are of equal size, but one or both of the loops can be fastened off center to make the sizes of its sub-loops different.

In FIG. 3, the four sub-loops 12*a*-1, 12*b*-1, 12*a*-2 and 12*b*-2 permit the ends of the scarf to be arranged in a flower-like shape. This is done by passing a scarf end in opposite directions through two adjacent sub-loops, e.g., 12*b*-1 and 12*a*-2, and pulling out the mid-part of the trapped scarf material. The other end of the scarf similarly can be passed through the other two sub-loops 12*a*-1 and 12*b*-2. With four sub-loops, the scarf parts can be arranged in a variety of ways. In each case the elastic cord of a sub-loop holds the scarf part in the position to which it is adjusted.

Figure 4:
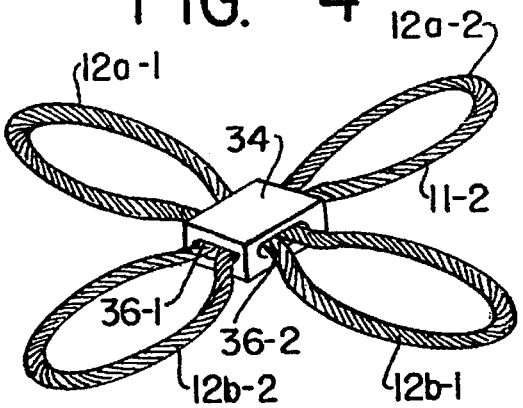
FIG. 4 is a cinch with multiple loops and having an adjustable mount.

FIG. 4 is another embodiment having an adjustable mount 34 for the two loops 11-1 and 11-2 of FIG. 3. Here the mount 34 has two transverse through channels 36-1 and 36-2 stacked one above the other, each for the two parts of a respective loop 11-1 and 11-2. As in the case of channel 18 of FIG. 2, each of the channels 36-1 and 36-2 provides a tight engaging, but sliding, fit for the two parts of the respective loop passing through it. This permits separate adjustment of each of the respective loops 11-1 or 11-2 relative to mount 34 to adjust the size of the sub-loops 12*a*-1 and 12*b*-1 and 12*a*-2 and 12*b*-2.

A mount for two closed loops can be provided such that one of the loops is fixed to the mount and the other loop is adjustable, such as by a channel in the mount for the loop that is to be adjustable. Thus, the size of the sub-loops of one of the loops 11 is fixed, and that of the sub-loops of the other is adjustable.

The multiple loop arrangement of FIGS. 2, 3 and 4 can be extended as desired. That is, for example, there can be three closed loops mounted 60° apart, four loops 45° apart, etc., with the loop parts being fastened as shown by any of the arrangement of FIGS. 1–4. The number of sub-loops is twice the number of closed loops. The mount for the multiple loop configuration can be fixed, as in FIGS. 1 and 3, or a mount used such as 34 of FIG. 4 where one or more through channels 38 are made at the required angles through the mount block.

Figure 5:
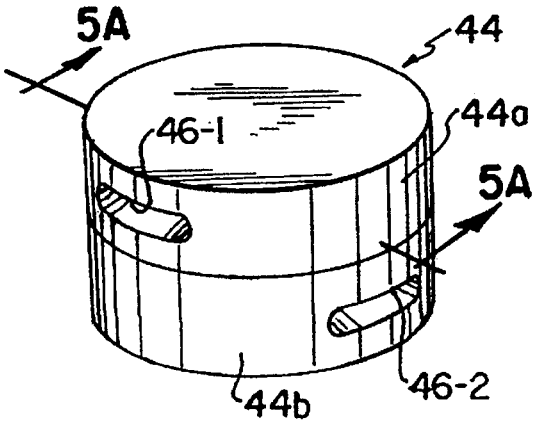
FIGS. 5 and 5A are a perspective and cross-sectional view of a cinch having adjustable loop lengths and angular positioning.
Figure 5A:
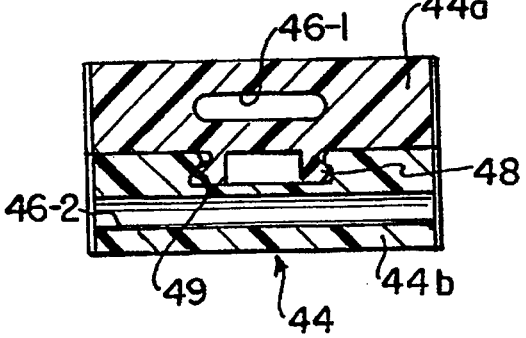

FIGS. 5 and 5A show a modified form of mounting block 44, in which the direction of the respective channels 46-1 and 46-2 of the block can be adjusted as desired. Here, the mounting block 44 is of two sections 44*a* and 44*b* of plastic or other suitable material, stacked one above the other. The sections 44*a* and 44*b* are held together by a press fit of a post 48 with a flared end fitting within a recess 49. This mounting arrangement permits rotation of one mount section and its loop relative to the other section. Each section 44*a*, 44*b* has the parts of a loop extending through a respective through channel 46-1 and 46-2. If desired, the loop in one of the sections 44 can be fixed to the mount. That is, there is no channel 46. Sections 44*a*, 44*b* are of any desired shape, e.g., circular discs, square or rectangular blocks, etc.

As can be seen, the scarf cinch of the invention permits a user to easily don a scarf without having to tie a knot. Also, the lay of the parts of the scarf can be adjusted as desired, in a large variety of decorative configurations. The use of the elastic cord permits expansion of the sub-loops so that scarf material of different thicknesses, layers and folds can be accommodated.

While scarfs fastened around the neck are shown in FIGS. 6 and 7 for illustrative purposes, it should be understood that the cinch can be used to fasten the scarf to other items. For example, the cinch can be used to fasten a scarf around the bowl of a hat to serve as a hatband, and the scarf parts arranged through the cinch loops to achieve the desired fashion effect. Also, the variations of how the scarf parts can be arranged by the user and held by the cinch are virtually endless, depending upon the user's desires and talent.

I claim:

1. A scarf cinch comprising:

at least one elastic cord forming a first and a second loop; and a mount block having a top wall surface, a bottom wall surface and a side wall surface between said top and bottom wall surfaces, parts of said first and second loops being within said block, said side wall surface having four exit openings between said top and bottom wall surfaces spaced around said side wall surface, a sub-loop of each of said loops exiting from a respective exit opening, each sub-loop for receiving and holding scarf material.

2. A scarf cinch as in claim 1 wherein said mount block is a fixed to the parts of said at least one cord to fixedly set the size of said sub-loops and their relative angular orientation relative to each other.

3. A scarf cinch as in claim 1 wherein said mount block has a through channel between said top and bottom side walls and defining a said exit opening at each end thereof, and said at least one elastic cord forming a closed loop disposed within said through channel and movable relative to said mount block along the length of the said closed loop to adjust the size of the sub-loops of said closed loop that extend through said exit openings.

4. A scarf cinch as in claim 1 wherein said at least one elastic cord is formed as a pair of closed loops and said mount has at least one channel defining on said exit opening at each end thereof and within which said loops are located to permit each of said loops to be individually movable along its length with respect to said mount block to adjust the size of the pair of sub-loops of each said loop extending through a said exit opening.

5. A scarf cinch as in claim 4 wherein said mount comprises a mount block having a pair of through channels with a respective exit opening at the end of each channel within each of which channels the opposing elastic cord parts of one of said closed loops are slidable.

6. A scarf cinch as in claim 4 wherein said mount block is generally circular.

7. A scarf cinch as in claim 4 wherein said mount block is generally polygonal.

8. A scarf cinch as in claim 1 wherein said exit openings are spaced at approximately 90° around said side wall surface and said sub-loops have the general shape of a four leaf clover.

9. A scarf cinch as in claim 1 wherein said mount block is generally circular.

10. A scarf cinch as in claim 1 wherein said mount block is generally polygonal.

11. A scarf cinch comprising:

a first and a second closed loop of elastic cord; and a mount attaching opposing parts of each of said first and second closed loops at an angular orientation with respect to each other to form a pair of sub-loops for each of said closed loops, each sub-loop for receiving and holding scarf material, wherein said mount is of two sections, at least one of said sections having a through channel within which the opposing elastic cord parts of one of said closed loops is slidable, and the other of said sections holding the opposing parts of the elastic cord of the other of said loops, and means for fastening said two sections while permitting a selected angular orientation therebetween.

12. A scarf cinch as in claim 11 wherein each of said sections has a through channel, the opposing elastic cord parts of one of said closed loops being slidable through a respective one of said channels.

* * * * *